US011132942B2

(12) United States Patent
Ko

(10) Patent No.: US 11,132,942 B2
(45) Date of Patent: Sep. 28, 2021

(54) LED DISPLAY DEVICE HAVING DECREASED DISPLAY IMAGE CROSSTALK

(71) Applicant: TLI Inc., Seongnam-si (KR)

(72) Inventor: Jaegan Ko, Seongnam-si (KR)

(73) Assignee: TLI INC., Seongnam-si (KR)

( * ) Notice: Subject to any disclaimer, the term of this patent is extended or adjusted under 35 U.S.C. 154(b) by 0 days.

(21) Appl. No.: 17/088,057

(22) Filed: Nov. 3, 2020

(65) Prior Publication Data

US 2021/0272509 A1 Sep. 2, 2021

(30) Foreign Application Priority Data

Mar. 2, 2020 (KR) ..... 10-2020-0025714

(51) Int. Cl.
*G09G 3/32* (2016.01)

(52) U.S. Cl.
CPC ..... *G09G 3/32* (2013.01); *G09G 2310/0267* (2013.01); *G09G 2310/0275* (2013.01); *G09G 2320/064* (2013.01)

(58) Field of Classification Search
CPC ... G09G 2310/0267; G09G 2310/0275; G09G 3/32; G09G 2320/064
See application file for complete search history.

(56) References Cited

U.S. PATENT DOCUMENTS 8,711,136 B2 * 4/2014 Park ..... G09G 3/006 345/211
9,275,606 B2 * 3/2016 Lee ..... G09G 3/2007
2006/0027822 A1 * 2/2006 Choi ..... G09G 3/3233 257/94
2020/0388219 A1 * 12/2020 Meng ..... G09G 3/2007

FOREIGN PATENT DOCUMENTS

KR 10-2008-0066421 7/2008

OTHER PUBLICATIONS

Hong-Jae Shin et al., "Design of Low Power OLED Driving Circuit", Division of Electrical and Computer Engineering, 2003, pp. 919-922.

* cited by examiner

*Primary Examiner* — Muhammad N Edun
(74) *Attorney, Agent, or Firm* — Kile Park Reed & Houtteman PLLC

(57) ABSTRACT

A light-emitting diode (LED) display device includes a display part having LED elements arranged in a matrix structure including scan lines and data lines. The LED display device also includes a scan driver driving the scan lines and each of the scan lines is controlled using a discharge voltage at a discharge timing. The LED display device also includes a data compensation part which compensates driving data of each of the data lines to generate the compensation data of each of the data lines using a compensation value to compensate for a difference in luminous intensity slope of the LED element due to a difference in the number of luminescence data lines at the unit scan timing. Thus, a crosstalk phenomenon of the display image due to a difference in the number of data lines simultaneously sourced is decreased.

11 Claims, 6 Drawing Sheets

LED DISPLAY DEVICE HAVING DECREASED DISPLAY IMAGE CROSSTALK

CROSS-REFERENCE TO RELATED APPLICATION

This application claims priority to and the benefit of Korean Patent Application No. 10-2020-0025714, filed on Mar. 2, 2020, the disclosure of which is incorporated herein by reference in its entirety.

BACKGROUND

1. Field of the Invention

The invention relates to a light-emitting diode (LED) display device, and more particularly, to an LED display device having a decreased crosstalk phenomenon of a display image.

2. Discussion of Related Art

A light-emitting diode (LED) display device is one of the passive matrix type display devices. The LED display device includes a plurality of LED elements arranged in a matrix structure including a plurality of scan lines and a plurality of data lines. Each of the LED elements emit light with a brightness according to an amount of electric charges flowing through the LED element during a sourcing time of the data line corresponding to the LED element. The brightness refers to luminous energy, which is light energy, and is a function of a luminous intensity and a luminescence time.

An unintentional self-capacitance is present in each of the LED elements. Accordingly, at a starting time point of luminescence, a current flowing in the LED element increases according to a predetermined 'luminous intensity slope'. The luminous intensity slope is the slope of luminous intensity over time.

Meanwhile, the LED element with the self-capacitance is charged due to driving of the corresponding data line. The data line is driven by sourcing a driving current having a predetermined amount. A brightness of the LED element is generally controlled by performing pulse width modulation on a length of a time within which the corresponding data line is sourced while a luminous intensity with a constant value is maintained.

However, the 'luminous intensity slope' is changed according to the number of data lines simultaneously sourced. Even when the data lines are sourced for the same time period, a brightness of each of the LED elements may be different from those of the other LED elements. Such a difference in brightness may cause distortion of a displayed image, and such distortion mainly occurs due to a crosstalk phenomenon which is interference between driving data due to the parasitic capacitances unintentionally generated in the LED elements.

SUMMARY

In the disclosure, described are embodiments of a light-emitting diode (LED) display device allowing a crosstalk phenomenon of a display image due to a difference in the number of data lines simultaneously driven to be decreased.

In an embodiment, an LED display device includes a display part including a plurality of LED elements arranged in a matrix structure including a plurality of scan lines and a plurality of data lines. Each of the plurality of LED elements emit light with a brightness based on a total amount of electric charges flowing through the LED element. The LED display device also includes a scan driver driving the plurality of scan lines and each of the scan lines is controlled using a discharge voltage at a discharge timing where the scan line selected at a unit scan timing is controlled using a light emitting voltage, and the unselected scan line is controlled to be in a floating state. The LED display device further includes a data driver including a plurality of sourcing units corresponding to the plurality of data lines. Each of the sourcing units drives the corresponding data line based on corresponding compensation data. The LED display device also includes a data compensation part which compensates driving data of each of the data lines to generate the compensation data of each of the data lines using a compensation value to compensate for a difference in luminous intensity slope of the LED element due to a difference in the number of luminescence data lines at the unit scan timing. A luminescence data line, among the plurality of data lines, is a data line which is driven such that the corresponding LED element emits light, and the luminous intensity slope is a time ratio at which the LED element emits light with a desired brightness. The compensation value is determined by reflecting a value of '(N−k)/N', wherein 'N' is the number of the plurality of data lines of the display part, 'k' is the number of the data lines corresponding to the driving data having a luminescence data value at the unit scan timing, and the luminescence data value is a data value causing the corresponding LED element to emit light.

Each of the sourcing units of the data driver includes a pulse width modulation (PWM) generator which generates a sourcing signal having an activation width based on the corresponding compensation data, a current source which sources a driving current having a predetermined amount, and a sourcing switch which is turned on by activation of the sourcing signal.

Each of the sourcing units of the data driver further includes a pre-charging unit which pre-charges the corresponding data line with a pre-charge voltage in response to activation of a pre-charging signal. The pre-charging signal is activated based on deactivation of the sourcing signal. The data compensation part generates the compensation data by adding the compensation value to the driving data having the luminescence data value. The luminescence data value is a data value causing the corresponding LED element to emit light. The data compensation part generates the compensation data by not reflecting the compensation value for the driving data having the non-luminescence data value. The data compensation part generates the compensation data having the same data value for the driving data having the non-luminescence data value. The compensation value is determined by reflecting values of k, N, and M, wherein 'M' is the number of the scan lines of the display part. The compensation value (ΔDATcp) is determined based on the equation $\Delta DATcp=\Delta Tcomp/Tck=(M-1)*Cpar*((N-k)/N)*(Vpr-((Vled-Von)*(1/Idr)*(1/Tck)$, wherein 'Cpar' is a self-capacitance of each of the LED elements, 'Vpr' is a level of the pre-charge voltage of each of data lines, 'Vled' is a level of the light emitting voltage, 'Von' is a threshold voltage of each of the LED elements, 'Idr' is an amount of a driving current of the luminescence data line, and 'Tck' is a time value corresponding to the data value '1' of the driving data.

The data compensation part includes a compensation value determination unit which receives the k to generate the compensation value, wherein the compensation value has a data value having a digital component, a plurality of data compensation units which correspond to the plurality of sourcing units of the data driver and receive the corresponding driving data to generate the corresponding compensation data, wherein each of the data compensation units generates the corresponding compensation data by adding the compensation value to the corresponding driving data having the luminescence data value and generates the compensation data having the same data value as the driving data for the corresponding driving data having the non-luminescence data value to activate a corresponding non-sourcing flag of the driving data, and a flag counting unit which counts the number of the activated non-sourcing flags of each of the data compensation units to generate the k.

Each of the data compensation units includes a non-sourcing confirmation unit which generates the corresponding non-sourcing flag activated in response to the corresponding driving data having the non-luminescence data value, an addition unit which adds the compensation value to the corresponding driving data to output addition data, and a multiplexing unit which outputs the driving data as the compensation data based on activation of the non-sourcing flag and outputs the addition data as the compensation data based on deactivation of the non-sourcing flag.

BRIEF DESCRIPTION OF THE DRAWINGS

The above and other objects, features and advantages of the disclosure will become more apparent to those of ordinary skill in the art by describing exemplary embodiments thereof in detail with reference to the accompanying drawings, in which.

DETAILED DESCRIPTION OF EMBODIMENTS

In the specification, components and action effects of a light-emitting diode (LED) display device displaying a single color image are mainly illustrated and described. However, this is only for clarification of explanation and understanding.

Figure 1:
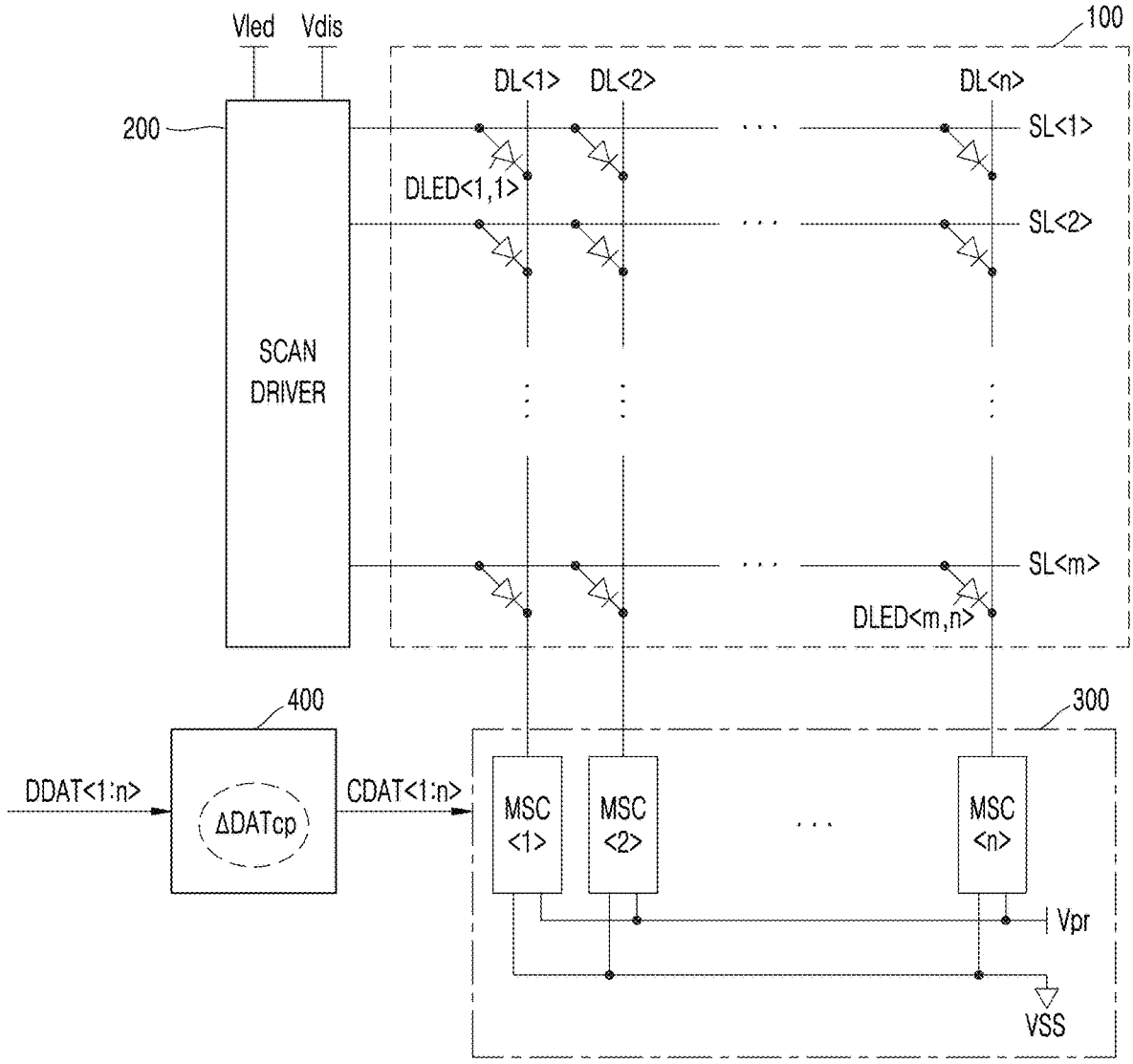
FIG. 1 is a schematic view illustrating a light-emitting diode (LED) display device according to an embodiment of the disclosure.

FIG. 1 is a schematic view illustrating an LED display device according to an embodiment of the disclosure. Referring to FIG. 1, the LED display device of the disclosure includes a display part 100, a scan driver 200, a data driver 300, and a data compensation part 400.

The display part 100 incudes a plurality of LED elements DLED<1,1> to DLED<m,n> disposed in a matrix structure including a plurality of scan lines SL<1:m> (here, m is a natural number greater than or equal to 2) and a plurality of data lines DL<1:n> (here, n is a natural number greater than or equal to 2).

Each of the plurality of LED elements DLED<1,1> to DLED<m,n> emits light with a brightness based on a total amount of electric charges flowing through each of the plurality of LED elements DLED<1,1> to DLED<m,n> between the scan line SL and the corresponding data line DL corresponding to the total amount of electric charges.

In certain embodiments, the LED element DLED is implemented as a PN diode and the like. In some embodiments, an unintentional self-capacitance is generated at a barrier of a PN junction surface. In the LED element DLED which is packaged, an unintentional self-capacitance may also be generated due to a package.

Figure 2:
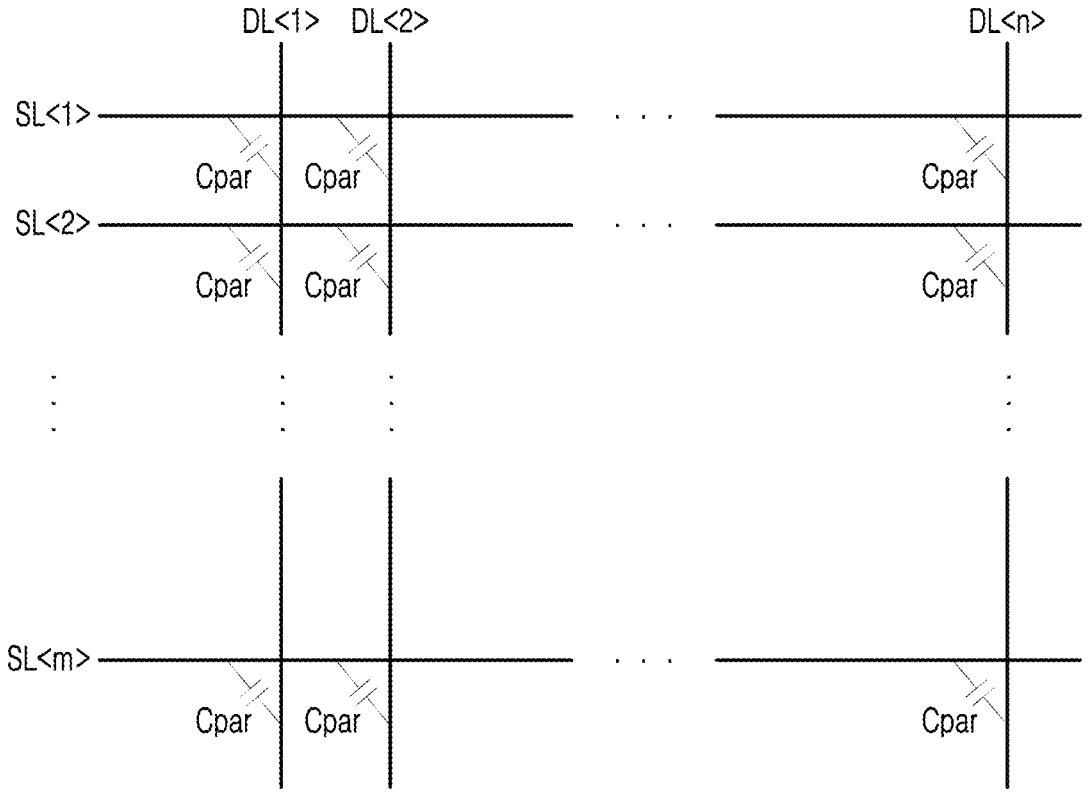
FIG. 2 is a modeling view illustrating self-capacitances of LED elements disposed in a display part according to an embodiment of the disclosure.

The self-capacitances of the LED elements DLED disposed in the display part 100 are modeled in FIG. 2. In certain embodiments, all the self-capacitances 'Cpar' of the LED elements DLED are assumed to be the same.

The scan driver 200 drives the plurality of scan lines SL<1:m>. In some embodiments, the plurality of scan lines SL<1:m> are controlled using a discharge voltage Vdis at a discharge timing (see 'T_DIS' of FIG. 4). The scan lines SL selected at a unit scan timing (see 'T_SCN' of FIG. 4) are controlled using a light emitting voltage Vled, and the unselected scan lines SL are controlled to be in floating states.

The data driver 300 includes a plurality of sourcing units MSC<1:n> corresponding to the plurality of data lines DL<1:n>. In certain embodiments, each of the plurality of sourcing units MSC<1:n> drives the corresponding data line DL<1:n> based on corresponding compensation data CDAT<1:n>.

Figure 3:
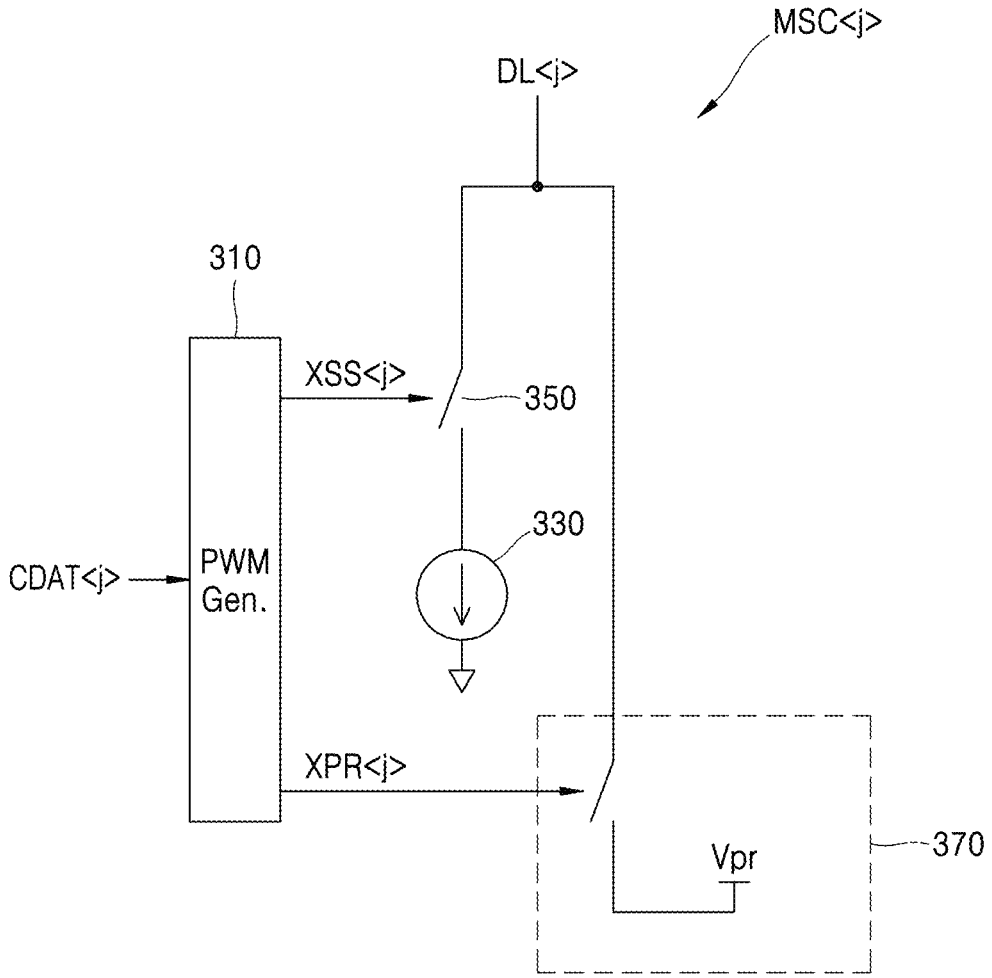
FIG. 3 is a diagrammatic view illustrating one of a plurality of sourcing units of a data driver according to an embodiment of the disclosure.

FIG. 3 is a diagrammatic view illustrating one of the plurality of sourcing units MSC<1:n> of the data driver 300, and the sourcing unit MSC<j> is representatively illustrated. Here, j is a natural number between 1 and n.

Referring to FIG. 3, the sourcing unit MSC<j> includes a pulse width modulation (PWM) generator 310, a current source 330, and a sourcing switch 350, and preferably further includes a pre-charging unit 370.

The PWM generator 310 generates a sourcing signal XSS<j> by modulating the corresponding compensation data CDAT<j>. In some embodiments, the sourcing signal XSS<j> has an activation width based on the compensation data CDAT<j>.

In certain embodiments, as a data value of the compensation data CDAT<j> increases, the activation width of the sourcing signal XSS<j> increases. In a case in which the data value of the compensation data CDAT<j> is '0', the activation width of the sourcing signal XSS<j> is '0'. In other words, in the case in which the data value of the compensation data CDAT<j> is '0', the sourcing signal XSS<j> maintains an inactive state.

The current source 330 sources an amount of the driving current Idr. According to the certain embodiments, the amount of driving current Idr sourced by the current source 330 of each of the plurality of sourcing units MSC<1:n> is constant.

The sourcing switch 350 is turned on by activation of the sourcing signal XSS<j>. Accordingly, the data line DL<j> is sourced by the driving current Idr based on activation of the corresponding sourcing signal XSS<j>.

The pre-charging unit 370 is driven to pre-charge the corresponding data line DL<j> with a pre-charge voltage Vpr in response to activation of a pre-charging signal XPR<j>. Preferably, the pre-charging signal XPR<j> is activated based on deactivation of the sourcing signal XSS<j>.

As a result, sourcing of the data lines DL<1:n> driven by the plurality of sourcing units MSC<1:n> of the data driver 300 is determined based on activation of the corresponding sourcing signals XSS.

For example, when a data value of the compensation data CDAT is '0', the sourcing signal XSS is deactivated, and in some embodiments, the corresponding LED element DLED does not emit light. In certain embodiments, the data line DL driven such that the corresponding LED element DLED does not emit light may be referred to as a 'non-luminescence data line', and a data value (in the some embodiments, '0') causing the corresponding LED element DLED to not emit light is referred to as a 'non-luminescence data value'.

Conversely, when the data value of the compensation data CDAT is not '0', the sourcing signal XSS is activated. In certain embodiments, the data line DL causing the corresponding LED element DLED to emit light may be referred to as a 'luminescence data line', and a data value (in the some embodiments, '1' or greater than '1') causing the corresponding LED element DLED to emit light is referred to as a 'luminescence data value'.

Meanwhile, the LED element DLED has a 'luminous intensity slope' which is changed based on a difference in the number of the data lines DL simultaneously sourced. In some embodiments, the 'luminous intensity slope' refers to the slope of a luminous intensity over time.

Due to such a difference in luminous intensity slope, even when the corresponding data line DL is sourced for the same sourcing time, a brightness of the LED element DLED is changed, which can be understood as a charge loss amount Qloss at a luminescence start time.

Next, the charge loss amount Qloss at the luminescence start time will be described.

In some embodiments, the charge loss amount Qloss will be mainly described for the case of a single color display, and will be additionally described for the case of a multi-color display.

Figure 4:
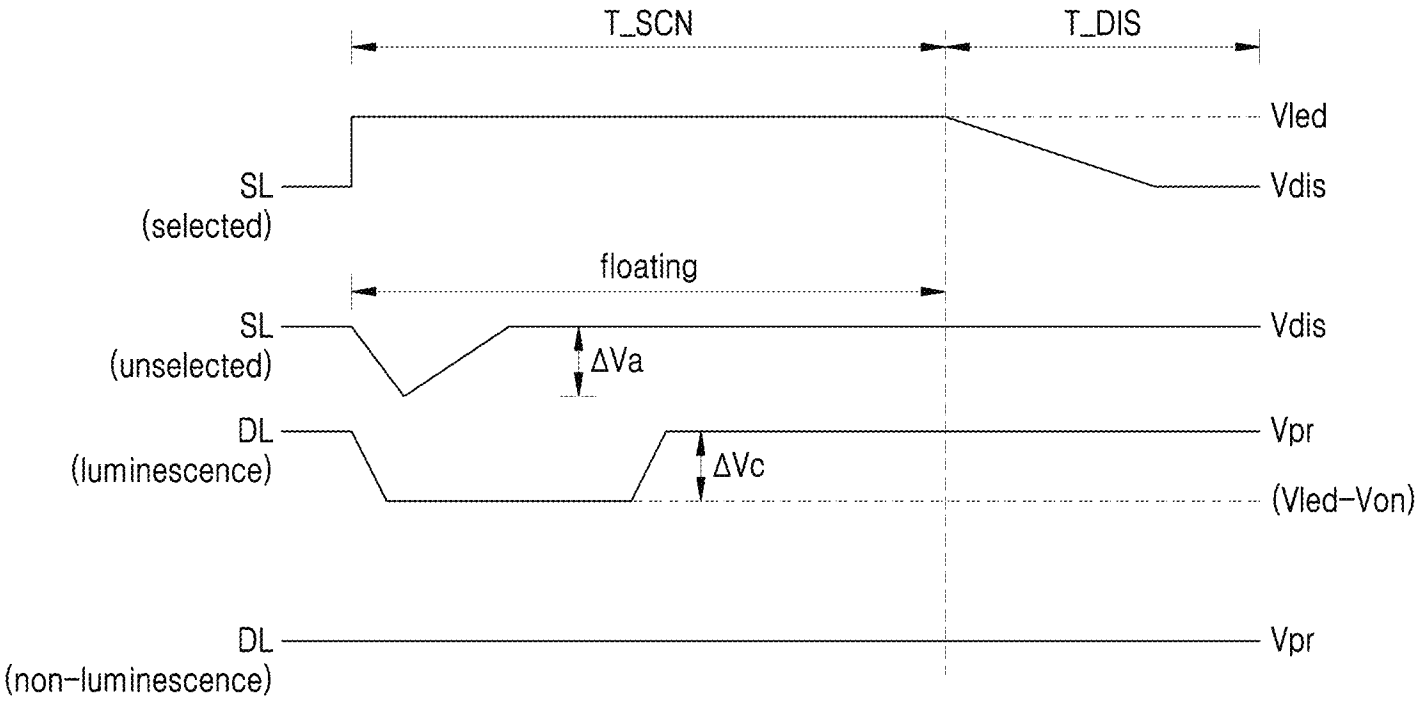
FIG. 4 is a diagrammatic view for illustrating a change in voltage level of scan lines and data lines at a unit scan timing according to an embodiment of the disclosure.

FIG. 4 is a diagrammatic view for illustrating a change in voltage level of the scan lines SL and the data lines DL at a unit scan timing.

Referring to FIG. 4, the selected scan line SL is controlled to have the light emitting voltage Vled, and the unselected scan line SL enters a floating state.

A voltage change of the data line DL (that is the luminescence data line) driven such that the corresponding LED element DLED emits light is ΔVc. In certain embodiments, ΔVc is expressed as in Equation 1 and is understood to be a predetermined constant value.

$$\Delta Vc = Vpr - (Vled - Von) \quad \text{[Equation 1]}$$

Here, Von is a 'threshold voltage of an LED element'.

In certain embodiments, the voltage change of the data line DL (that is, the non-luminescence data line) driven such that the corresponding LED element DLED does not emit light is '0'.

Since the unselected scan line SL is in the floating state, the unselected scan line SL is lowered by ΔVa due to coupling with the luminescence data line. In some embodiments, charge amounts charged in the LED elements DLED with the self-capacitances Cpar are '0' like a state before sourcing started.

Accordingly, Equation 2 is established.

$$Csc*\Delta Va + k*Cpar*(\Delta Va - \Delta Vc) + (N-k)*Cpar*\Delta Va = 0 \quad \text{[Equation 2]}$$

Here, N is the number of the plurality of data lines DL, and k is the number of the data lines DL which are simultaneously sourced. Csc is a parasitic self-capacitance of the corresponding scan line SL.

In certain embodiments, when the Csc is ignored in Equation 2, Equation 2 becomes Equation 3.

$$k*Cpar*(\Delta Va - \Delta Vc) + (N-k)*Cpar*\Delta Va = 0 \quad \text{[Equation 3]}$$

The ΔVa is derived from Equation 3 to be expressed as in Equation 4.

$$\Delta Va = \Delta Vc*k/N \quad \text{[Equation 4]}$$

From Equation 4, it can be seen that a voltage change amount ΔVa of the unselected scan line SL depends on k/N.

Meanwhile, the number of the LED elements DLED connected to a luminescence data line DL and the unselected scan lines SL is M−1. In some embodiments M is the number of the plurality of scan lines SL.

Accordingly, when electric charges are supplied through the corresponding data line DL such that the LED element DLED emits light, the charge loss amount Qloss occurring due to the self-capacitances Cpar of the LED elements DLED connected to the unselected scan lines SL is expressed as in Equation 5. In certain embodiments, since a charge amount lost due to the self-capacitance Cpar of the LED element DLED emitting light is always constant, the charge loss amount Qloss may not be considered.

$$Qloss = (M-1)*Cpar*(\Delta Vc - \Delta va) = (M-1)*Cpar*(N-k)/N*\Delta Vc = (M-1)*Cpar*((N-k)/N)*(Vpr-(Vled-Von)) \quad \text{[Equation 5]}$$

As seen in Equation 5, it can be seen that the charge loss amount Qloss relates to the number k of the data lines DL which are simultaneously sourced.

Figure 5:
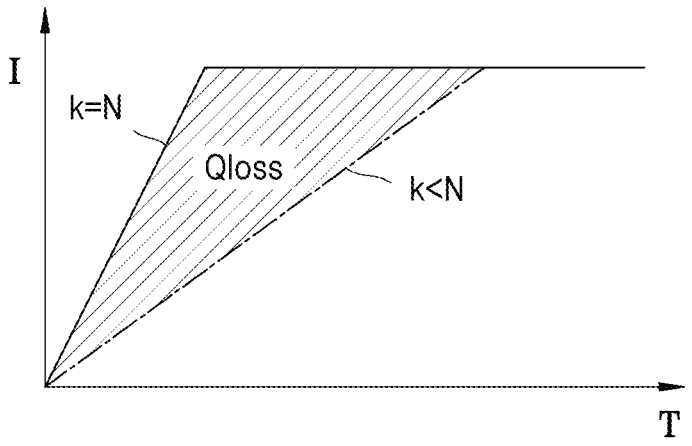
FIG. 5 is a graph view for illustrating a charge loss amount and a difference in luminous intensity slope according to a value k in the LED display device according to an embodiment of the disclosure.

FIG. 5 is a graph view for illustrating the charge loss amount Qloss and a difference in luminous intensity slope based on a value of k in the LED display device of the disclosure.

Referring to FIG. 5, it can be seen that as the value of k decreases, the charge loss amount Qloss increases, and the luminous intensity slope decreases.

In the LED display device of the disclosure, in order to compensate for the charge loss amount Qloss, the corresponding data line DL is sourced for a sourcing time based on the compensation data CDAT compensating driving data DDAT.

Further referring to FIG. 1, the data compensation part 400 compensates the driving data DDAT of each of the plurality of data lines DL<1:n> to generate the compensation data CDAT<1:n> using a compensation value ΔDATcp to compensate for a difference in luminous intensity slope of the LED element at the unit scan timing T_SCN based on a difference in the number of the luminescence data lines.

In certain embodiments, the compensation value ΔDATcp is a data value for compensating for the charge loss amount Qloss.

Next, determination of the compensation value ΔDATcp will be described.

First, an additional sourcing time ΔTcomp of the luminescence data line DL for compensating for the charge loss amount Qloss is expressed as in Equation 6.

$$\Delta Tcomp = Qloss/Idr = (M-1)*Cpar*((N-k)/N)*(Vpr-(Vled-Von))*(1/Idr) \quad \text{[Equation 6]}$$

When the additional sourcing time ΔTcomp is expressed using the compensation value ΔDATcp which is a digital data value, the additional sourcing time ΔTcomp is expressed as in Equation 7.

$$\Delta DATcp = \Delta Tcomp/Tck = (M-1)*Cpar*((N-k)/N)*(Vpr-(Vled-Von))*(1/Idr)*(1/Tck) \quad \text{[Equation 7]}$$

Here, Tck is a unit time corresponding to a unit data value of the driving data DDAT.

Further referring to FIG. 1, the operation and configuration of the data compensation part 400 will be specifically described.

The data compensation part 400 generates the compensation data CDAT by reflecting the compensation value ΔDATcp for the driving data DDAT having the 'luminescence data value'.

The data compensation part 400 generates the compensation data CDAT by not reflecting the compensation value ΔDATcp for the driving data DDAT having the 'non-luminescence data value'.

That is, in a case in which a data value of the driving data DDAT is '0', a data value of the compensation data CDAT is also '0'.

One example of the data compensation part 400 that performs the above operation is illustrated in FIG. 5.

Figure 6:
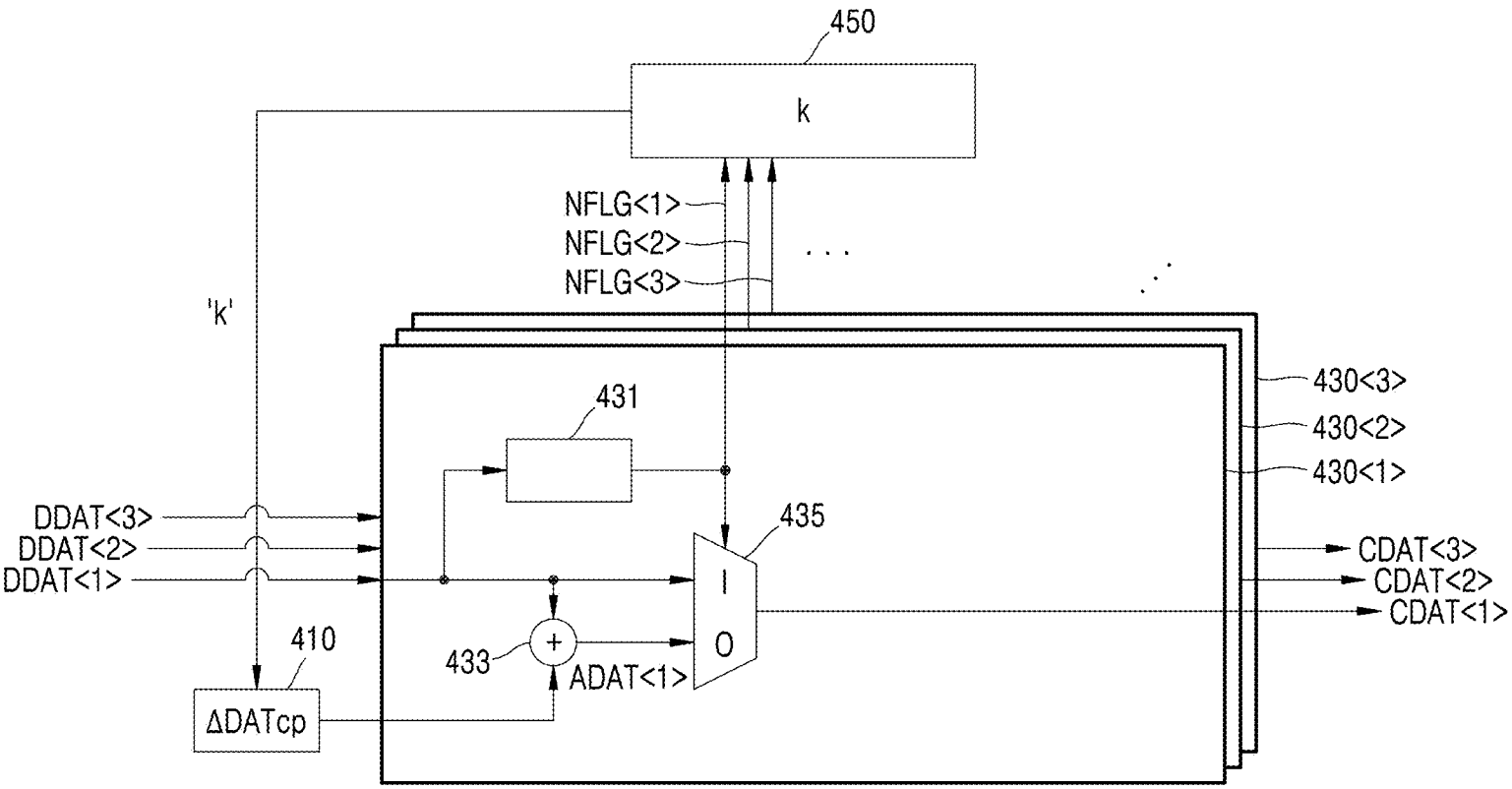
FIG. 6 is a diagrammatic view illustrating a data compensation part according to an embodiment of the disclosure.

FIG. 6 is a diagrammatic view illustrating the data compensation part 400. Referring to FIG. 6, the data compensation part 400 includes a compensation value determination unit 410, a plurality of data compensation units 430<1:n>, and a flag counting unit 450.

The compensation value determination unit 410 receives the k to generate the compensation value ΔDATcp. In some embodiments, the compensation value ΔDATcp is a data value having a digital component and may be obtained using Equation 6 as described above.

The plurality of data compensation units 430<1:n> correspond to the plurality of sourcing units MSC<1:n> of the data driver 300 and receive the corresponding driving data DDAT to generate the corresponding compensation data CDAT.

In certain embodiments, each of the plurality of data compensation units 430<1:n> adds the compensation value ΔDATcp to the corresponding driving data DDAT having the 'luminescence data value' to generate the corresponding compensation data CDAT. Each of the plurality of data compensation units 430<1:n> generates the compensation data CDAT having the same data value as the driving data DDAT for the corresponding driving data DDAT having the 'non-luminescence data value' and activates a corresponding non-sourcing flag NFLG<1:n>.

More specifically, each of the plurality of data compensation units 430<1:n> includes a non-sourcing confirmation unit 431, an addition unit 433, and a multiplexing unit 435.

The non-sourcing confirmation unit 431 generates the corresponding non-sourcing flag NFLG activated in response to the corresponding driving data CDAT having the non-luminescence data value.

The addition unit 433 adds the compensation value ΔDATcp to the corresponding driving data DDAT to output addition data ΔDAT.

The multiplexing unit 435 outputs the driving data DDAT as the compensation data CDAT based on activation of the non-sourcing flag NFLG and outputs the addition data ΔDAT as the compensation data CDAT based on deactivation of the non-sourcing flag NFLG.

Further referring to FIG. 6, the flag counting unit 450 counts the number of the activated non-sourcing flags NFLG<1:n> of each of the plurality of data compensation units 430<1:n> to generate the k.

In order to explain the compensation value ΔDATcp in a case in which a multicolor image is displayed, generalization of the above equations will be described.

Current LED display devices generally display a multicolor image having 3 or 4 colors. In some embodiments, in FIG. 1, it is clear to those skilled in the art that each of the LED elements DLED<1,1> to DLED<m,n> is implemented to include light-emitting diodes in a number corresponding to kinds of displayed colors.

In certain embodiments, Equation 1 to Equation 7 may be respectively generalized as in Equation 8 to Equation 14. In some embodiments, parameters may be distinguished by adding '_i' based on color type.

Here, i identifies a color type, in the case of a three-color display, i is in the range of 1 to 3, and in the case of a four-color display, i is in the range of 1 to 4.

Equation 1 is generalized as in Equation 8.

$$\Delta Vc_i = Vpr_i - (Vled - Von_i) \quad \text{[Equation 8]}$$

Equation 2 is generalized as in Equation 9.

$$(Csc*\Delta Va) + \sum (k_i*Cpar_i*(\Delta Va - \Delta Vc_i)) + \sum ((N_i - k_i)*Cpar_i*\Delta Va = 0 \quad \text{[Equation 9]}$$

Here, ΔVa is commonly used regardless of color.

Equation 3 in which the Csc is ignored is generalized as in Equation 10.

$$\sum (k_i*Cpar_i*(\Delta Va - \Delta Vc_i)) + \sum ((N_i - k_i)*Cpar_i*\Delta Va) = 0 \quad \text{[Equation 10]}$$

Equation 4 is generalized as in Equation 11.

$$\Delta Va = \sum (\Delta Vc_i*k_i*Cpar_i) / \sum (N_i*Cpar_i) \quad \text{[Equation 11]}$$

Equation 5 is generalized as in Equation 12.

$$Qloss_i = (M-1)*Cpar_i*(\Delta Vc_i - \Delta Va) \quad \text{[Equation 12]}$$

Equation 6 is generalized as in Equation 13.

$$\Delta Tcomp_i = Qloss_i / Idr_i \quad \text{[Equation 13]}$$

Equation 7 is generalized as in Equation 14.

$$\Delta DATcp_i = \Delta Tcomp_i / Tck \quad \text{[Equation 14]}$$

In short, each of the plurality of LED elements DLED of the LED display device of the disclosure has the self-capacitance Cpar due to properties of the LED element implemented as a PN junction and the like. Due to the self-capacitances Cpar of the LED elements DLED, the luminous intensity slopes of the LED elements DLED emitting light may be different from each other due to a difference in the number of data lines DL which are sourced simultaneously.

In certain embodiments, in the LED display device of the disclosure, the driving data DDAT of each the plurality of data lines DL is compensated by the data compensation part 400 and provided as the compensation data CDAT. The driving of the luminescence data line DL by the data driver 300 depends on the compensation data CDAT in which the compensation value ΔDATcp is added to the driving data DDAT. That is, the sourcing time of the luminescence data line DL increases, and thus the charge loss amount Qloss is compensated for.

Accordingly, in the LED display device of the disclosure, a difference in luminous intensity slope of the LED elements DLED due to a difference in the number of the luminescence data lines is compensated for.

As a result, a distortion phenomenon of a display image due to a difference in the number of the data lines DL simultaneously sourced is decreased.

According to the LED display device of the disclosure including the above-described components, a difference in luminous intensity slope of an LED element due to a difference in the number of data lines which simultaneously luminesce (are simultaneously sourced) at one unit scan timing is compensated for. As a result, the LED display device of the disclosure, a distortion phenomenon of a display image due to a difference in the number of data lines simultaneously sourced is decreased.

In concluding the detailed description, those skilled in the art will appreciate that many variations and modifications may be made to the embodiments without substantially departing from the principles and spirit and scope of the disclosure. Therefore, the disclosed embodiments are used in a generis and descriptive sense only and not for purposes of limitation.

What is claimed is:

1. A light-emitting diode (LED) display device comprising:

a display part including LED elements arranged in a matrix structure including scan lines and data lines, wherein each of the LED elements emits light with a brightness based on a total amount of electric charges flowing through the LED element;

a scan driver that drives the scan lines, wherein each of the scan lines is controlled using a discharge voltage at a discharge timing, the scan line selected at a unit scan timing is controlled using a light emitting voltage, and the unselected scan line is controlled to be in a floating state;

a data driver including sourcing units corresponding to the data lines, wherein each of the sourcing units drives the corresponding data line based on corresponding compensation data; and a data compensation part which compensates driving data of each of the data lines to generate the compensation data of each of the data lines using a compensation value to compensate for a difference in luminous intensity slope of the LED element due to a difference in the number of luminescence data lines at the unit scan timing, wherein a luminescence data line, among the data lines, is a data line which is driven such that the corresponding LED element emits light, and the luminous intensity slope is a time ratio at which LED element emits light with a desired brightness, wherein the compensation value is determined by reflecting a value of '(N−k)/N', wherein 'N' is the number of the data lines of the display part, 'k' is the number of the data lines corresponding to the driving data having a luminescence data value at the unit scan timing, and the luminescence data value is a data value causing the corresponding LED element to emit light.

2. The LED display device of claim 1, wherein each of the sourcing units of the data driver includes:

a pulse width modulation (PWM) generator which generates a sourcing signal having an activation width based on the corresponding compensation data;

a current source which sources a driving current having a predetermined amount; and a sourcing switch which is turned on by activation of the sourcing signal.

3. The LED display device of claim 2, wherein each of the sourcing units of the data driver further includes a pre-charging unit which pre-charges the corresponding data line with a pre-charge voltage in response to activation of a pre-charging signal, and the pre-charging signal is activated based on deactivation of the sourcing signal.

4. The LED display device of claim 1, wherein the data compensation part generates the compensation data by adding the compensation value to the driving data having the luminescence data value, and the luminescence data value is a data value causing the corresponding LED element to emit light.

5. The LED display device of claim 4, wherein the data compensation part generates the compensation data by not reflecting the compensation value for the driving data having the non-luminescence data value.

6. The LED display device of claim 5, wherein the data compensation part generates the compensation data having the same data value for the driving data having the non-luminescence data value.

7. The LED display device of claim 4, wherein the compensation value is determined by reflecting values of k, N, and M, wherein 'M' is the number of the scan lines of the display part.

8. The LED display device of claim 7, wherein the compensation value (ΔDATcp) is determined based on the equation $$\Delta DATcp=\Delta T\text{comp}/Tck=(M-1)*Cpar*((N-k)/N)*(Vpr-((V\text{led}-V\text{on})*(1/Idr)*(1/Tck),$$

wherein 'Cpar' is a self-capacitance of each of the LED elements, 'Vpr' is a level of the pre-charge voltage of each of data lines, 'Vied' is a level of the light emitting voltage, 'Von' is a threshold voltage of each of the LED elements, 'Idr' is an amount of a driving current of the luminescence data line, and 'Tck' is a time value corresponding to the data value '1' of the driving data.

9. The LED display device of claim 4, wherein the data compensation part includes:

a compensation value determination unit which receives the k to generate the compensation value, wherein the compensation value has a data value having a digital component;

data compensation units which correspond to the sourcing units of the data driver and receive the corresponding driving data to generate the corresponding compensation data, wherein each of the data compensation units generates the corresponding compensation data by adding the compensation value to the corresponding driving data having the luminescence data value and generates the compensation data having the same data value as the driving data for the corresponding driving data having the non-luminescence data value to activate a corresponding non-sourcing flag of the driving data; and a flag counting unit which counts the number of the activated non-sourcing flags of each of the data compensation units to generate the k.

10. The LED display device of claim 9, wherein each of the data compensation units includes:

a non-sourcing confirmation unit which generates the corresponding non-sourcing flag activated in response to the corresponding driving data having the non-luminescence data value;

an addition unit which adds the compensation value to the corresponding driving data to output addition data; and a multiplexing unit which outputs the driving data as the compensation data based on activation of the non-sourcing flag and outputs the addition data as the compensation data based on deactivation of the non-sourcing flag.

11. A light-emitting diode (LED) display device comprising:

a display part including LED elements arranged in a matrix structure including scan lines and data lines, wherein each of the LED elements emits light with brightness based on a total amount of electric charges flowing through the LED element;

a scan driver that drives the scan lines, wherein each of the scan lines is controlled using a discharge voltage at a discharge timing, the scan line selected at a unit scan timing is controlled using a light emitting voltage, and the unselected scan line is controlled to be in a floating state;

a data driver including sourcing units corresponding to the data lines, wherein each of the sourcing units drives the corresponding data line based on corresponding compensation data; and a data compensation part which compensates driving data of each of the data lines to generate the compensation data of each of the data lines using a compensation value to compensate for a difference in luminous intensity slope of the LED element due to a difference in number of luminescence a lines at the unit scan timing, wherein a luminescence data line, among the data lines, is a data line which is driven such that the corresponding LED element emits light, and the luminous intensity slope is a time ratio which LED element emits light with a desired brightness, wherein the data compensation part generates the compensation data by adding the compensation value to the driving data having the luminescence data value, and the luminescence data value is a data value causing the corresponding LED element to emit light, and wherein the data compensation part includes:

a compensation value determination unit which receives the number of luminescence data lines to generate the compensation value, wherein the compensation value has a data value having a digital component;

data compensation units which correspond to the sourcing units of the data driver and receive the corresponding driving data to generate the corresponding compensation data, wherein each of the data compensation units generates the corresponding compensation data by adding the compensation value to the corresponding driving data having the luminescence data value and generates the compensation data having the same data value as the driving data for the corresponding driving data having the non-luminescence data value to activate a corresponding non-sourcing flag of the driving data; and a flag counting unit which counts the number of the activated non-sourcing flags of each of the data compensation units to generate the number of luminescence data lines.

* * * * *